US006063012A

United States Patent [19]

Berkowitz et al.

[11] Patent Number: 6,063,012

[45] Date of Patent: May 16, 2000

[54] PORTABLE MULTI-USE EXERCISE DEVICE

[76] Inventors: Eric Berkowitz, 800 W. Ave. #706, Miami Beach, Fla. 33139; Lisa Paul, 3101 Port Royale Blvd., Apt. 434, Ft Lauderdale, Fla. 33308

[21] Appl. No.: 09/105,564

[22] Filed: Jun. 26, 1998

[51] Int. Cl.[7] ..... A63B 21/04

[52] U.S. Cl. ..... 482/121; 482/124; 482/130

[58] Field of Search ..... 482/124, 121, 482/904, 129, 130, 142, 140; D21/687

[56] References Cited

U.S. PATENT DOCUMENTS

| | | | |
|---|---|---|---|
| 4,327,909 | 5/1982 | Neufeld | 482/124 |
| 5,141,482 | 8/1992 | Hern | 482/130 |
| 5,203,754 | 4/1993 | Maclean | 482/124 |
| 5,558,609 | 9/1996 | Olschansky | 482/122 |

*Primary Examiner*—Jerome Donnelly
*Attorney, Agent, or Firm*—John C. Smith

[57] ABSTRACT

A portable exercise device that uses a single centrally located bungee to provide equal tension on both sides of a user's back. A seat attachment strap secures the device to a seat back. In one embodiment, an optional pad worn by the user is secured to a tension strap which is attached at its ends to the bungee. The tension strap is held in place on the seat attachment strap by retaining straps mounted on the seat attachment strap. To exercise the abdominal muscles, the user leans forward causing the single tension cord to exert equal pressure on the side straps thereby exercising the abdominal muscles. By reversing position, the user may exercise back muscles by leaning backward, or exercise chest and arm muscles by pushing against the seat back with the user's arms. An alternative embodiment uses a chest strap that is centrally attached to the tension strap by a centrally located attachment strap. Another alternative embodiment attaches the tension strap directly to the chest strap. Yet another embodiment attaches the bungee directly to the seat attachment belt and the chest strap, eliminating the tension straps. In this embodiment, the tension cord is centrally attached between the user and the seat back. The exercise device can also be used in conjunction with push-up handles to exercise the user's arms and chest.

14 Claims, 13 Drawing Sheets

PORTABLE MULTI-USE EXERCISE DEVICE

BACKGROUND OF THE INVENTION

1. Technical Field

The present invention relates to multi-use exercise devices. In particular, it relates to a portable exercise device which allows the user to exercise abdominal, back, arm and chest muscles while performing other activities.

2. Background Art

The time limitations created by everyday life make it difficult for many individuals to exercise. In addition, many individuals not only do not have an opportunity to exercise, but are required to spend many hours in sedentary positions due to their employment, time spent traveling, time spent recovering from injury, etc. It would be advantageous to provide individuals with the benefits of exercise; including abdominal and back physical rehabilitation, posture improvement, and muscle development while performing sedentary activities that are required in daily life.

Attempts have been made to provide a dual use of time wherein an individual can exercise at the same time that sedentary activities were taking place. For example, in U.S. Pat. No. 5,141,482 to Hern, an exercise device was provided that attaches to a seat and to a user. The user exercises while sitting by pushing forward against two side mounted tensioning cords. While this invention allows the abdominal muscles to be exercised, it has several drawbacks which limit its use. First, the device uses two tension cords. Since each tension cord will vary in strength, the result will be that one side or the other will provide greater tension and the user will tend to exercise one side of the abdominal muscles to a greater extent, resulting in uneven muscle growth, which in turn may contribute to poor posture and lower back pain.

Second, and more importantly, many individuals spend a great deal of time commuting. As a result, a good opportunity to make dual use of time for both sedentary activities and exercising is in a vehicle. However, the use of side mounted cords will interfere with the use of the user's arms while driving, thus creating a safety hazard. Further, since the cords stretch under the arms of the user, if they snap due to cord failure, they may contribute to an accident. Also, since the cords retract as the driver reclines against the seat back, the cords may become loose in the reclining position and interfere with the free movement of the drivers arms.

It would be desirable to have an exercise device that can be used in a variety of situations, such as driving, where the individual's arms would not be interfered with, so that a potential safety hazard could be avoided. Further, it would be desirable to have an exercise device that would evenly distribute tension during exercise to both sides of an individuals abdomen and/or back without favoring one side over the other, thereby fostering even muscle development.

Prior art devices, such as the foregoing device, have numerous components, each of which is susceptible to failure. It would also be desirable to have a device with a minimal number of components and a simple construction.

While addressing the basic desirability of exercising, the prior art has failed to provide an exercise device that uses a minimal number of components; that uses a single centrally located tension source to equally balance tension forces such that both sides of the abdomen and back are exercised equally; that does not expose the user to injury if the tension source fails; and that does not interfere with the use of the individual's arms during use.

SUMMARY OF THE INVENTION

The present invention solves the foregoing problems by providing a portable abdominal and back muscle exercise device that uses a single centrally located tension cord to provide equal tension on either side of a user's abdomen or back. A securing strap secures the device to a fixed location such as a seat back. A tension strap is attached to the tension cord at its ends and slidably attached to the securing strap. The tension strap is separable near its midpoint to allow it to be secured around a user. It may also be used in conjunction with an optional pad for user comfort. To exercise the abdominal muscles, the user leans forward causing the single tension cord to be stretched such that equal pressure is exerted on both sides of the tension strap. To exercise the back muscles, the user sits facing the seat back and leans backward causing the single tension cord to be stretched such that equal pressure is exerted on both sides of the user. The arm and chest muscles may also be exercised from this position by using the arms to push away from the seat back. An alternative embodiment uses a single chest strap that is centrally attached to single tension strap by a centrally located attachment strap. The tension strap is attached to a single tension cord that creates tension when the tension strap is pulled by the user when the user leans forward during abdominal exercise and backwards during back exercise. Another alternative embodiment attaches the tension strap directly to the chest strap. Yet another embodiment attaches the tension cord directly to the securing strap and the chest strap, thereby eliminating the tension straps. In this embodiment, the tension cord is centrally attached between the user and the seat back. The exercise device may be attached to the back of a chair, an automobile seat, a hospital bed, a wheelchair, or even a post to allow the user to exercise while driving, performing office work, watching television, etc. The device may be used to exercise back muscles by reversing the position of the user.

DESCRIPTION OF THE PREFERRED EMBODIMENT

Figure 1A:
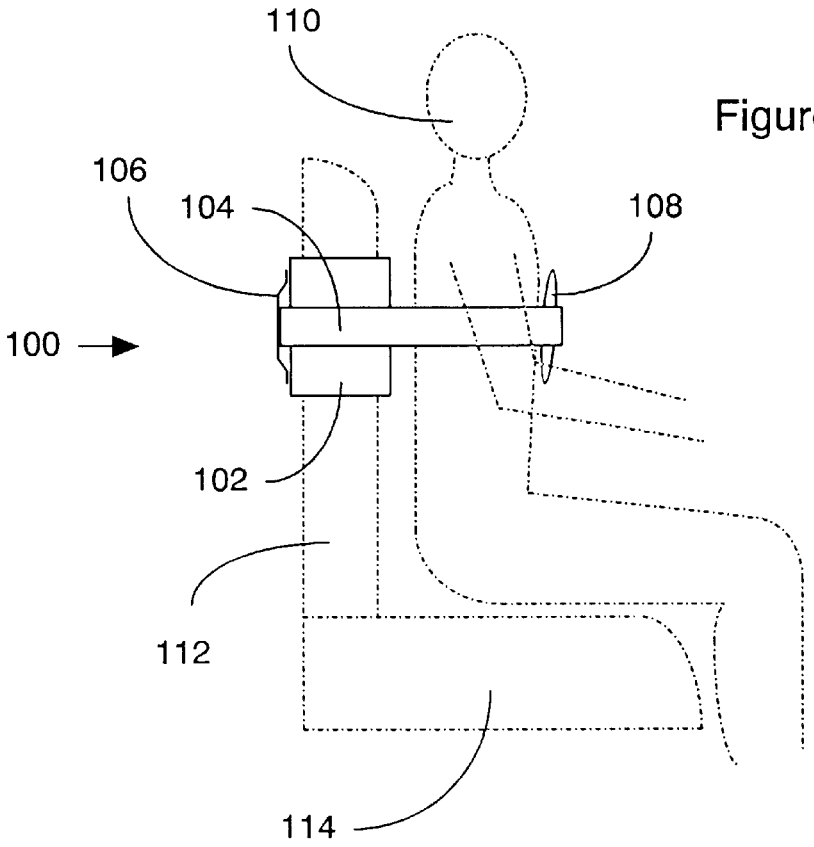
FIG. 1A is a side view of a preferred embodiment showing the exercise device in the relaxed position while attached to a seat back and a user.

Prior to a discussion of the figures, a general discussion of the features and advantages of the invention follows. The invention is a single device that accomplishes several functions. The device uses a securing strap that is secured to a fixed support, such as a seat back, a pole, push-up handles that rest on a floor, etc., in conjunction with a tension strap that the user presses against to exercise the user's muscles. The ends of the tension strap are secured to each other by an extendable tension producing device, such as a bungee cord or rubber band, etc. For ease of discussion, the tension producing device will be referred to hereinafter as a "bungee" even though it may in fact be any other suitable tension producing device, such as a rubber band. As the user pulls away from the securing strap, the tension strap pulls on the bungee to increase tension.

A significant benefit of the device is that it is a therapeutic device that can be used to alleviate back pain due to its ability to foster correct posture by strengthening abdominal and back muscles.

Another benefit of the device is that it allows a user to exercise while performing time consuming activities, such as while commuting, while traveling as a passenger in an aircraft, or even while watching television. For example, the invention can be secured to the back of a vehicle seat such that an occupant of the vehicle can exercise while traveling. As a result, the user has the benefit of being able to exercise without having to dedicate time from an otherwise busy day.

In addition, the same device can be used to exercise a variety of muscle groups. If attached to the back of a seat, the user can exercise abdominal muscles by leaning forward. If the user turns around and faces the seat back, the user can lean back to exercise the user's back muscles. In the same position, if the user pushes against the back of the seat, the user can exercise the arm and chest muscles. Those skilled in the art will recognize that the same exercises can be done by attaching the securing strap to other fixed objects, and that it does not have to be used solely with a seat back. In addition to exercising the upper body, the device can also be used to exercise the legs. The user can attach the securing strap to a floor mounted object (for example, push-up handles) and then exercise the calf muscles from a seated position, or the thigh muscles by doing deep knee bends under tension.

The device provides another significant advantage due to its portability. Since it only has a few components, namely a securing strap, a tension strap, and a bungee, it is lightweight and easy to fold and pack for travel. This allows the device to be taken by the user when traveling. In addition to the components listed above, an optional pad can be placed between the user and the tension strap to increase user comfort.

The bungee can be replaced with other bungee's of varying tension values to suit the needs and physical condition of a particular user. Likewise, the desired strength of the bungee will vary depending on the muscles being exercised. For example, the leg muscles are typically stronger than the arm muscles and would therefore require greater force to exercise them.

Another benefit of the device is that when used in conjunction with a vehicle, it will augment the seatbelt of the vehicle, resulting in greater safety to the user.

Having discussed the benefits and advantages of the invention in general, we turn now to a detailed description of the figures. Referring to FIG. 1A, this figure shows a side view of exercise device 100 attached to the back of a chair or automobile seat. Those skilled in the art will recognize that in addition to a seat back, any suitable securing point, for example a wheelchair, a hospital bed, a post, etc. may be used in place of the chair or automobile seat. A user 110 and conventional chair or automobile seat, which is comprised of a seat 114 and a seat back 112, are shown in dashed lines for illustrative purposes. A securing strap 102 secures the exercise device 100 to the seat back 112. Tension strap 104 is slidably attached to the securing strap 102 by retaining straps 106 and extend around the chest of user 110. The tension strap 104 does not stretch in the preferred embodiment, and therefore does not produce any tension itself. The tension is actually created by bungee 120 which is discussed below in regard to FIG. 2.

In the preferred embodiment, tension strap 104 is actually split into two segments to allow it to be secured around user 110. The two segments are secured together by hook and loop material or any other convenient means. The segments of tension strap 104 may be secured together, or alternatively, they may be secured to the optional pad 108 providing that the optional pad 108 has the proper hook and loop surface for attachment.

While the segments of tension strap 104 may be secured directly to one another, in the preferred embodiment an optional pad 108 is used for enhancing the comfort of user 110. When using the optional pad 108, the segments of tension strap 104 are preferably independently attached to the optional pad 108. By independently attaching the segments of tension strap 104, the user 110 can balance the fit of the exercise device 100 on either side of the user 110. The preferred method of attaching the segments of tension strap 104 to each other or to an optional pad 108 is through the use of hook and loop material. However, those skilled in the art will recognize that any suitable method of attachment may be used, such as zippers, buttons, snaps, hooks, knots etc.

The user 110 in this figure is shown in the relaxed (or non-tension) position. In the relaxed position, the user 110 rests against the seat back 112 and no pressure is applied to the tension strap 104 by the bungee 120 (shown in FIG. 1B). Once secured, the user 110 must push against the tension straps 104 to move forward (i.e. away from the securing strap 102. As the user relaxes, the tension strap 104 will pull the user 110 back to the seat back 112. This forward and backward motion causes the user's 110 abdominal muscles to be exercised. Since bungee 120 provides the only source of tension, and the tension strap 104 does not stretch, the central placement of bungee 120 provides an equal amount of force on either side of the user 110, resulting in a more uniform muscle development. Further, the location of the bungee 120 behind the seat back 112 protects the user 110 in the event bungee 120 fails by braking and snapping. This provides additional safety to the user 110, who would have been injured in the event one of the side mounted tension cords of prior art devices had failed.

Figure 1B:
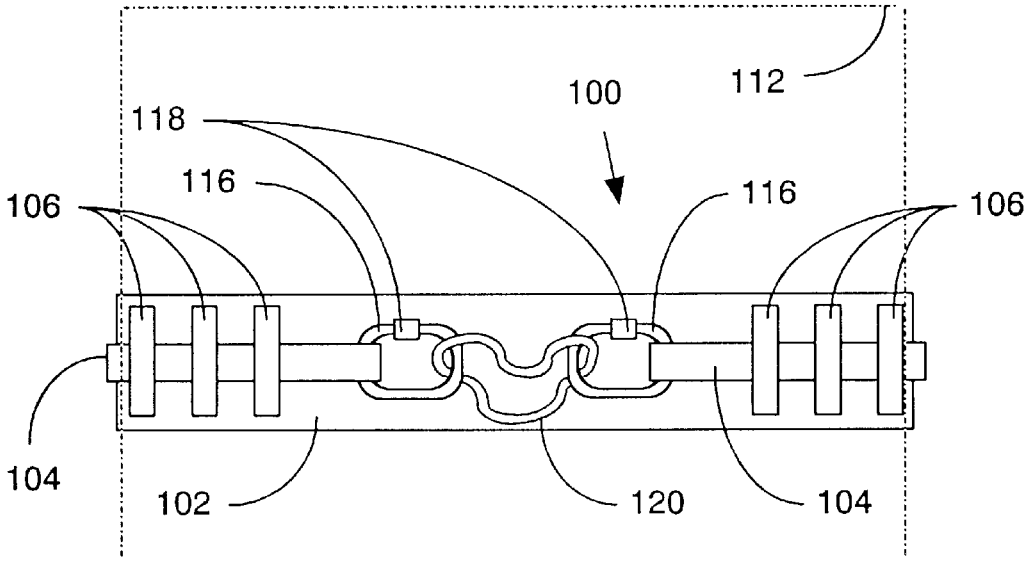
FIG. 1B is a rear view of a preferred embodiment of the exercise device in the relaxed position while attached to a seat back.

In FIG. 1B, a rear view is shown of the abdominal exercise device 100 installed on a seat back 112. Securing strap 102 is secured to seat back 112. The tension strap 104 is slidably attached to securing strap 102 by retaining straps 106. The ends of tension strap 104 are attached to bungee 120 by attachment rings 116. The attachment rings 116 can be opened by threaded nuts 118 to allow insertion of tension cord 120 and side straps 104. In the preferred embodiment, bungee 120 is made from bungee material. However, those skilled in the art will recognize that any suitable method, in addition to attachment rings 116, may be used to attach bungee 120 to tension strap 104. For example, attachment rings 116 and associated threaded nuts 118 can be eliminated and the tension strap 104 can be looped through bungee 120 and secured via hook and loop material. Further, the bungee 120 can be made from a variety of materials in addition to bungee, such as rubber bands, so long as the material will stretch and provide tension as it is pulled by the tension strap 104.

In this figure the exercise device 100 is shown in the relaxed position, in which bungee 120 is not exerting any tension on tension strap 104.

Figure 2A:
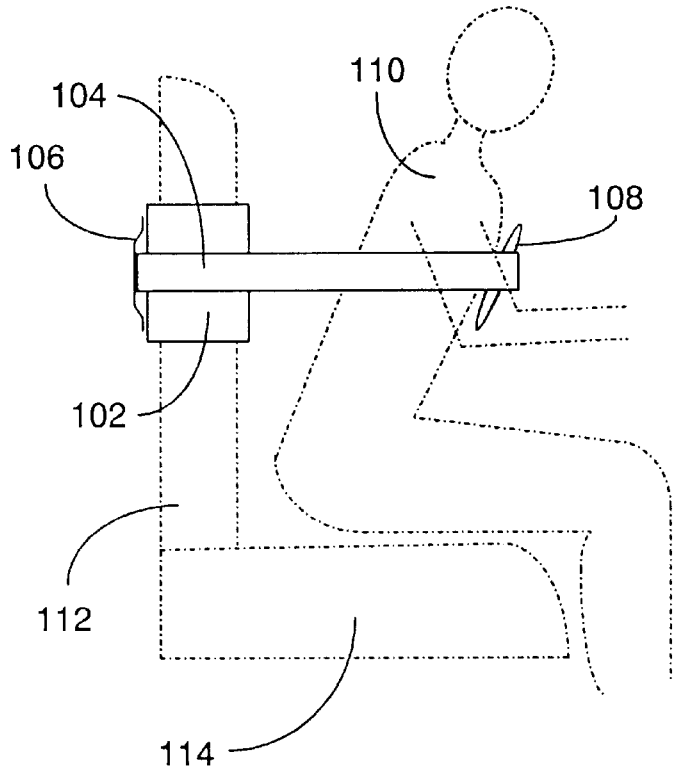
FIG. 2A is a side view of a preferred embodiment showing the exercise device in the tensioned position while attached to a seat back and a user.

Regarding FIG. 2A, this figure shows the exercise device 100 in the tension position. In this position, the user 110 bends forward on seat 114, pulling tension strap 104 which is attached to optional pad 108. As the user 110 bends forward, tension strap 104 pulls on bungee 120, increasing tension. This tension requires the user 110 to press harder to bend forward, thereby exercising the abdominal muscles of user 110.

Figure 2B:
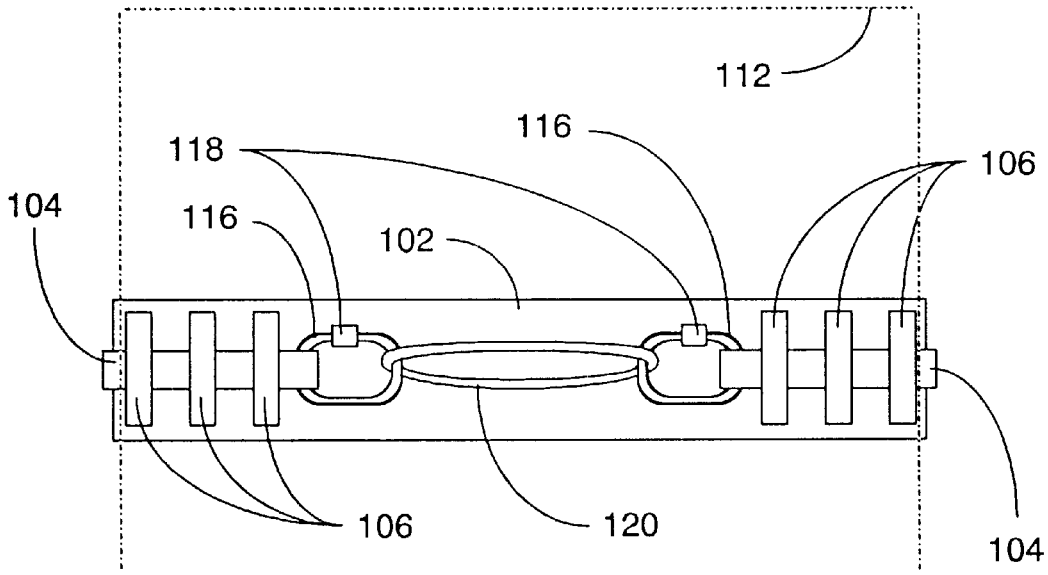
FIG. 2B is a rear view of a preferred embodiment of the exercise device in the tensioned position while attached to a seat back.

FIG. 2B shows a rear view of the exercise device 100 installed on a seat back 112. In the tension position, the tension strap 104 pulls on bungee 120 as it slides between retaining straps 106 and securing strap 102. Retaining straps 106 are used to align the tension strap 104 with securing strap 102, thereby preventing tension strap 104 from rubbing against the seat back 112. While three retaining straps 106 are shown on each side of bungee 120, those skilled in the art will recognize that any suitable number of retaining straps 106 can be used.

For ease of illustration, only a single bungee 120 is shown. Further, the bungee 120 that is shown is illustrated as a single loop. However, bungees 120 of varying strengths may be substituted for one another, more than one bungee 120 may be used at the same time, and the bungee 120 may be looped to increase tension. Whether, one or more bungees 120 are used, they effectively act as a single centrally located source of tension to provide a balanced tension on both sides of the user's 110 body. This allows a user 110 to vary the tension based on the user's 110 strength or training goals or medical prescription.

An advantage associated with the ease of replacement or adjustment of the bungee 120 is that a user can use a combination of bungees 120 for a training program or a series of exercises. In addition, the use of the exercise device 100 for back and leg muscle development, as discussed more fully below, is enhanced by the ability to easily change the amount of tension to suit the particular muscle group being exercised.

Figure 2C:
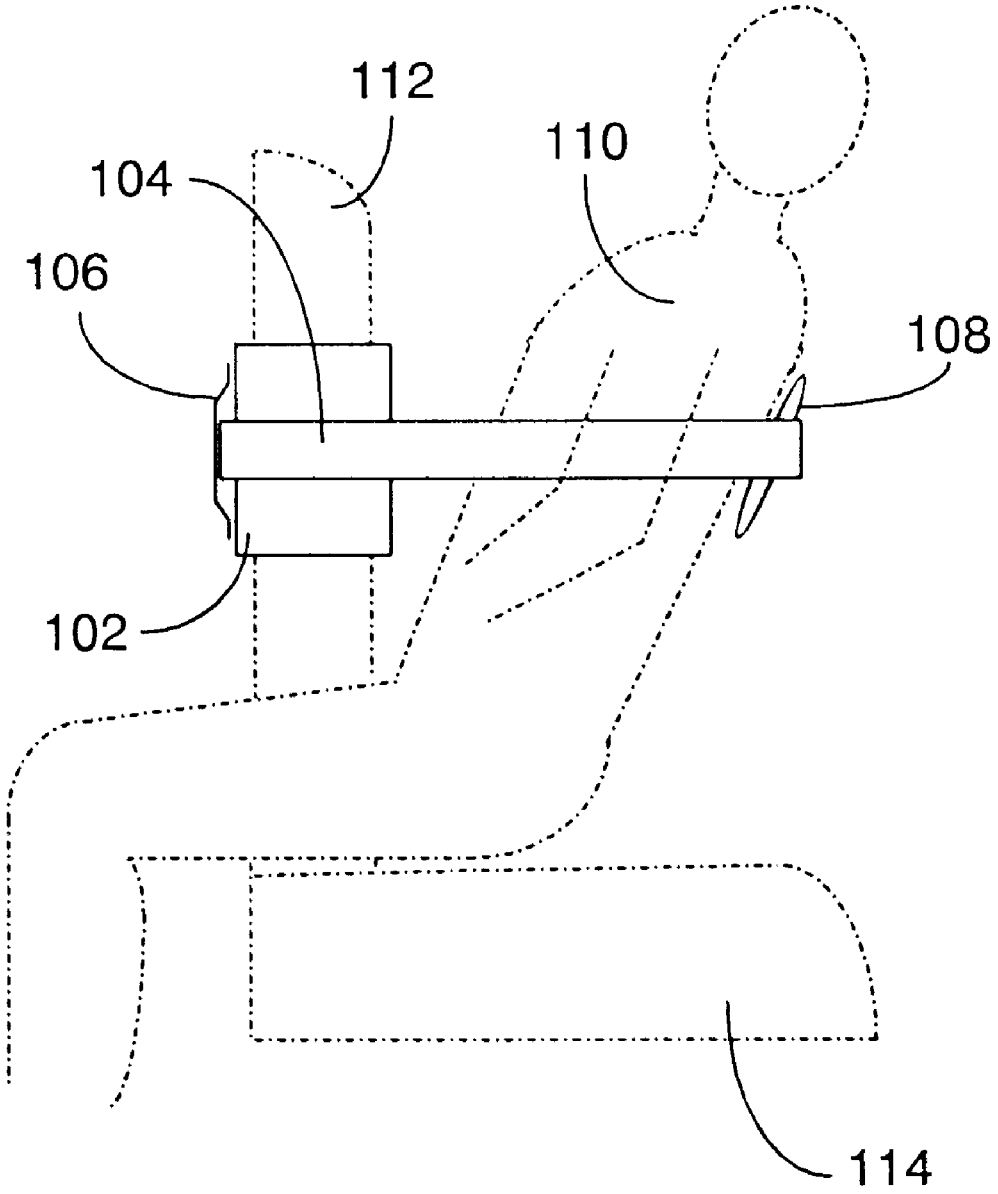
FIG. 2C is a side view of a preferred embodiment showing the exercise device in the tensioned position while attached to a seat back and a user. In this figure, the user has reversed position to exercise the back muscles instead of the abdomen muscles.

Regarding FIG. 2C, this figure illustrates an alternative method of using exercise device 100. In this configuration, the user 110 turns around on the seat 114. When the user 110 lean back, as shown in the figure, the user's 110 back muscles are exercised instead of the abdomen muscles. As a result, the same exercise device 100 can be used to exercise either the abdomen or the back muscles. This allows the user 110 to exercise both sides of the user's 110 torso with the same device, resulting in a stronger upper body and better posture.

Figure 2D:
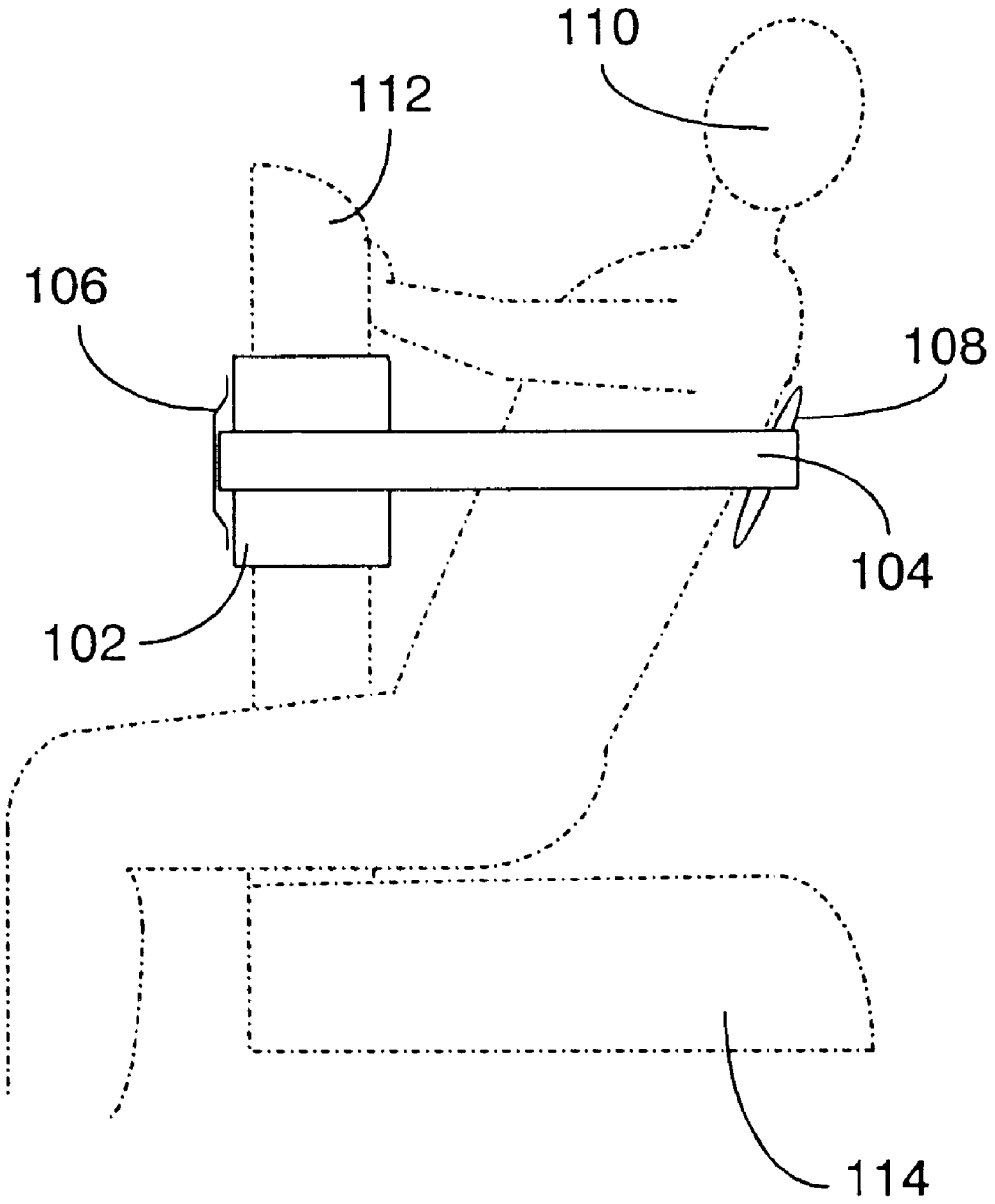
FIG. 2D is a side view of a preferred embodiment showing the exercise device in the tensioned position while attached to a seat back and a user. In this figure, the user has reversed position and is pushing against the seat back with the user's arms to exercise the arm and chest muscles.

In FIG. 2D, another alternative method of using exercise device 100 is illustrated. In this figure, the user faces the seat as was discussed in regard to FIG. 2C, above. However, instead of pushing back using the back muscles, the user 100 pushes against the seat back 112. By so doing, the user 110 exercises the arm and chest muscles. As a result, the user 110 can exercise the abdomen, back, arm and chest muscles with the same exercise device 100.

Figure 3A:
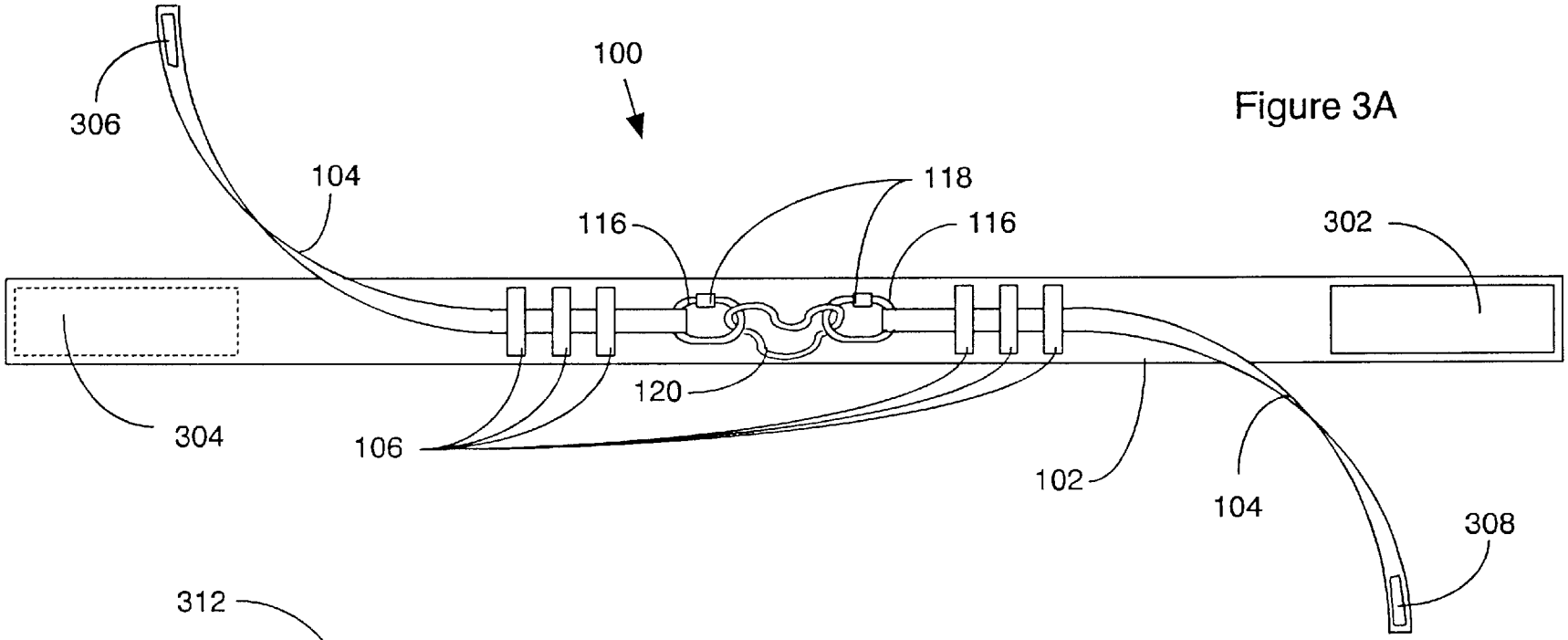
FIG. 3A is a plan view illustrating a preferred embodiment of the exercise device while uninstalled from a seat back.

FIG. 3A shows the exercise device 100 laid flat. Securing strap 102 can be made from any flexible material, such as cotton, synthetic fibers, plastics, polyethylene, polypropylene, etc. It can also be single or multi-layer. The only requirement is that it be sufficiently flexible to wrap around a seat back 112 and be strong and durable enough to serve its purpose.

In the preferred embodiment, hook and loop strips 302, 304 are attached to each end of securing strap 102. Hook and loop strip 304 is illustrated in dashed lines to indicate that it is attached to the opposite side of securing strap 102 from hook and loop strip 302. When securing strap 102 is wrapped around seat back 112, hook and loop strips 302, 304 are attached to one another to secure securing strap 102 to seat back 112. An advantage of using hook and loop strips 302, 304 as the attachment means is that it allows the securing strap 102 to be easily secured to any size seat back 112.

Figure 3B:
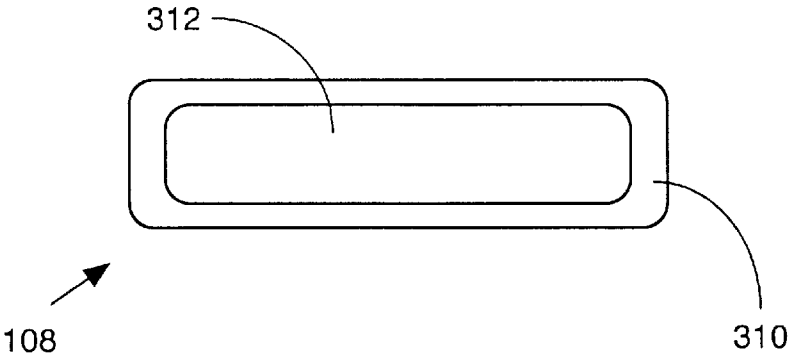
FIG. 3B is illustrating the a preferred embodiment of the optional pad used with the exercise device.

In FIG. 3B, the optional pad 108 is shown. In the preferred embodiment, the front surface 310 of pad 108 is at least partially covered with an attachment pad 312 of hook and loop material. When securing strap 102 is secured to the seat back 112, side straps 104 are wrapped around the sides of the user 110 and secured to attachment pad 312 by hook and loop segments 306, 308 (shown in FIG. 3A). As was the case above, those skilled in the art will recognize that other attachment means can be used, but hook and loop material is preferred due to its simplicity, cost and ease of use.

Figure 4:
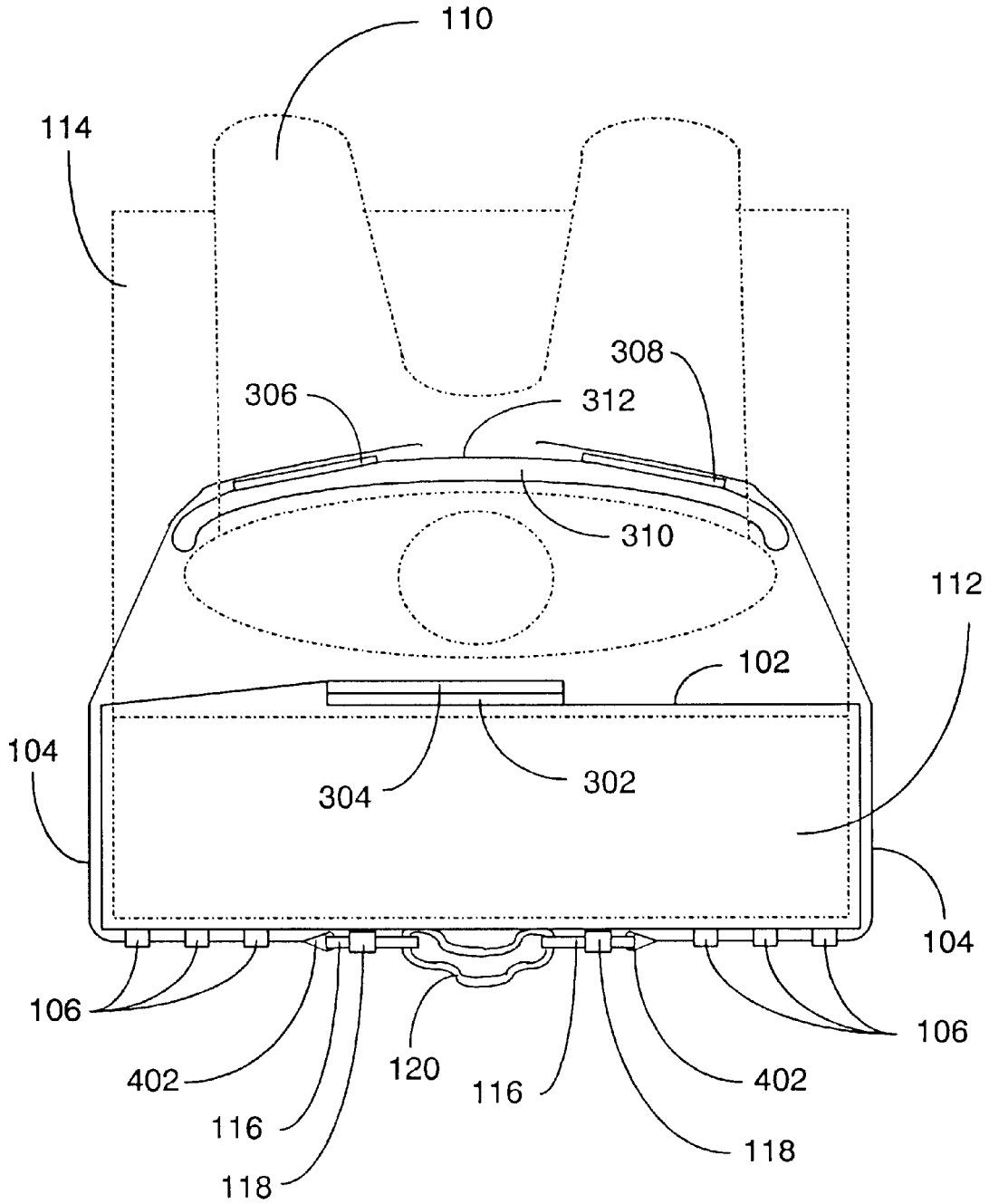
FIG. 4 is a top view of a preferred embodiment showing the exercise device in the relaxed position while attached to a seat back and a user.

FIG. 4 shows a top view of the exercise device 100 when attached to a seat back 112. In this view, the user 110 is in the relaxed position. Securing strap 102 is shown secured to seat back 112 via hook and loop segments 302, 304. Tension strap 104 is secured to the attachment pad 312 of optional pad 310 via hook and loop segments 306, 308. The proximal ends of side straps 104 are secured to attachments rings 116 which are in turn secured to bungee 120. In the relaxed position, bungee 120 will be loose and not apply tension to tension strap 104.

When the user 110 leans forward, tension strap 104 will be pulled forward and bungee 120 will exert tension on it. As a result, the user 110 will be able to exercise the user's muscles while performing other activities, such as waiting for a traffic light to change, watching television, talking on the phone, working at a desk, etc.

Figure 5:
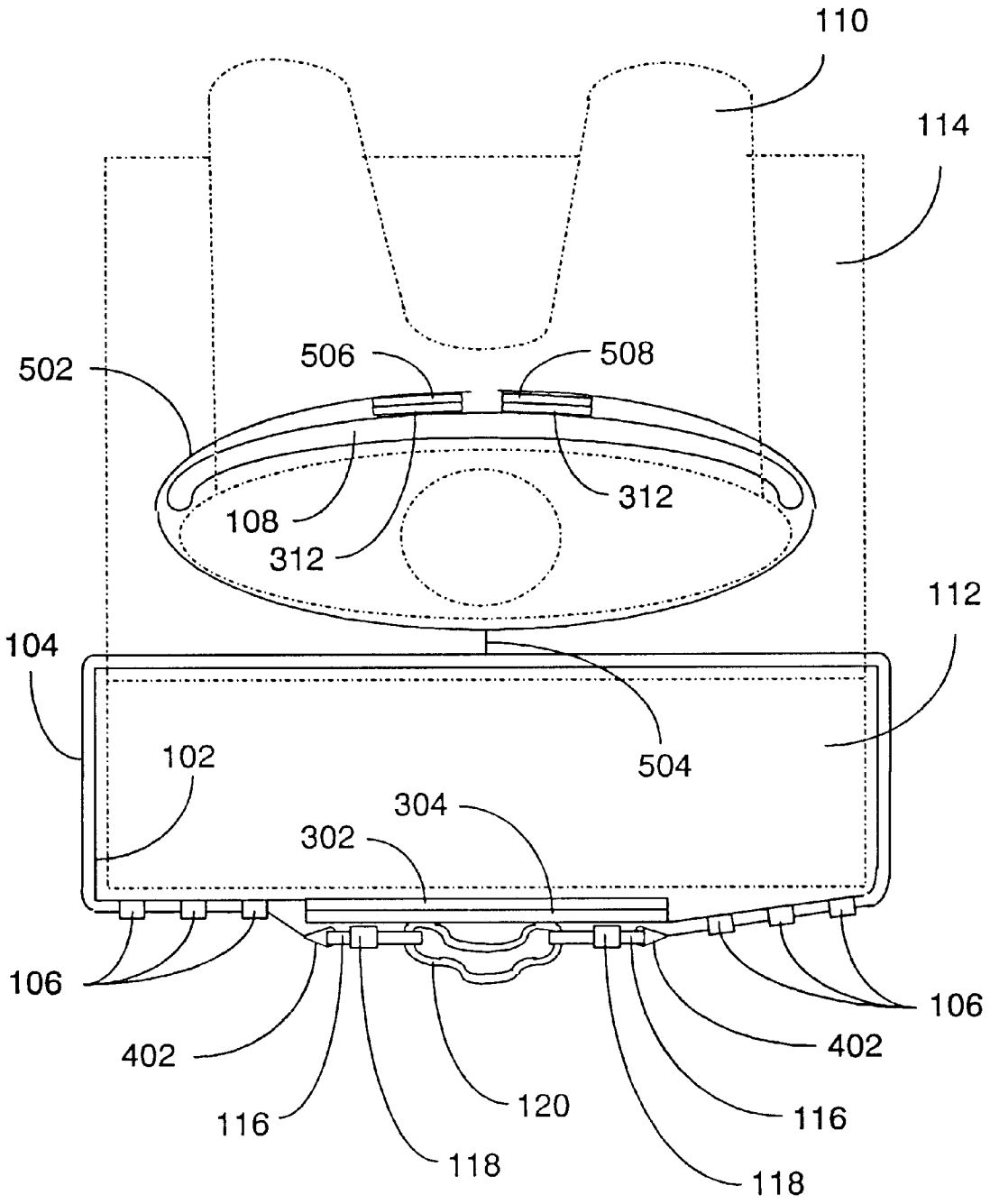
FIG. 5 is a top view of an alternative preferred embodiment showing the exercise device in the relaxed position while attached to a seat back and a user. This embodiment uses a single, centrally located attachment strap.

FIG. 5 illustrates an alternative embodiment. In this embodiment, the tension strap 104 is wrapped around the securing strap 10. The tension strap 104 is attached to bungee 120 in the same manner as previously described. The user 110 wraps a chest strap 502 around the user's 110 chest and secures it to the hook and loop attachment pad 312 on optional pad 108 via hook and loop segments 506, 508. The tension strap 104 is attached to chest strap 502 via attachment strap 504. In the preferred embodiment, attachment strap 504 is centrally located. This allows the user 110 to exercise the muscles on either side of the user's 110 body equally.

This embodiment provides an advantage over the embodiment in which the tension strap 104 is directly wrapped around the user 110, as described in FIG. 1 above. The centrally located attachment strap 504 makes it more difficult for a user 110 to inadvertently favor one side of the user's 110 body. Further, the use of a single centrally located attachment strap 504 will not cause any interference with the user's 110 freedom of motion while performing some activities, such as driving, reading magazines, etc.

To facilitate the central attachment of attachment strap 504, the securing strap 102 is mounted on the seat back 112 with the hook and loop strips 302, 304 on the back side of the seat back 112.

Figure 6:
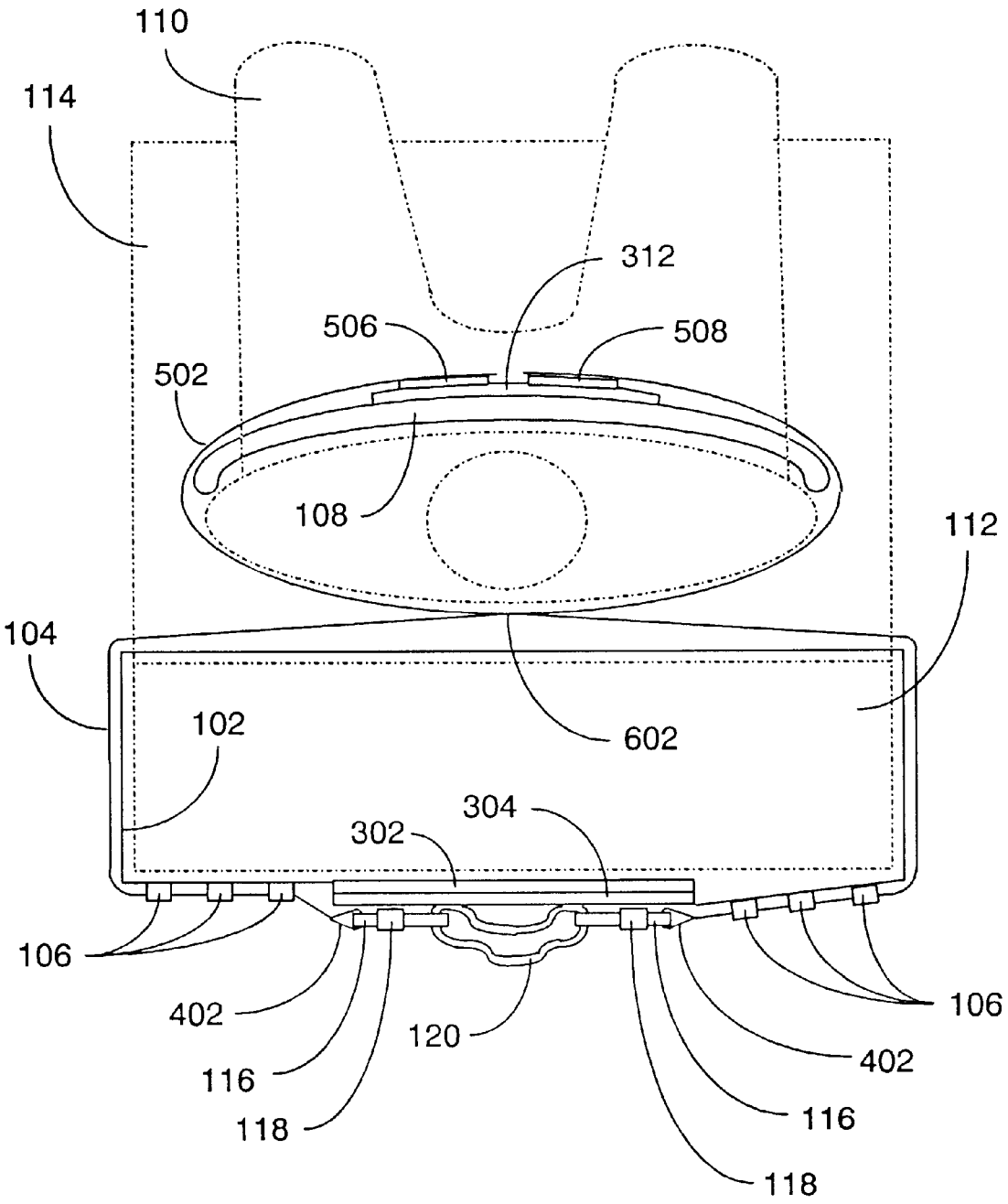
FIG. 6 is a top view of another alternative preferred embodiment showing the exercise device in the relaxed position while attached to a seat back and a user. This embodiment attaches the tension strap to a chest strap at a single centrally located point.

FIG. 6 is another embodiment which is similar to the embodiment of FIG. 5. In this embodiment, the attachment strap 504 is eliminated and the tension strap 104 is attached directly to chest strap 502. In the preferred embodiment, the attachment point should be centrally located to ensure that force is applied equally by each side of the user's 110 body.

In this embodiment the user 110 would first attach the securing strap 102 to the seat back. Then the user would sit on the seat 114 and attach the chest strap 502 to the attachment pad 312 of optional pad 108 via hook and loop segments 506, 508. Of course, the optional pad 108 can be eliminated and the hook and loop 506, 508 segments could be designed to be attached to each other.

This embodiment eliminates any potential interference with the user's 110 arms that may occur in embodiments that use tension straps 104 that wrap around the user's 110 body.

Figure 7:
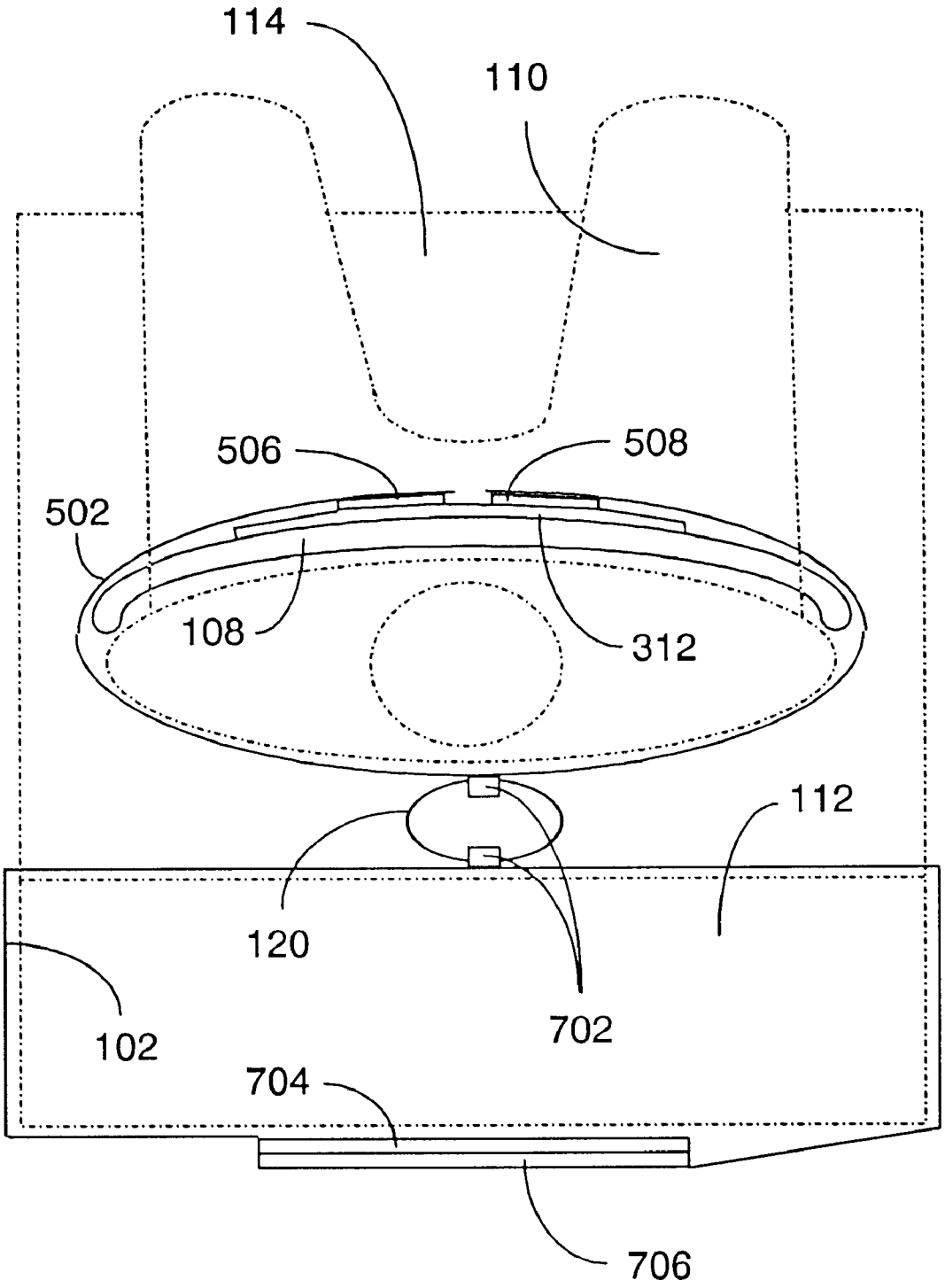
FIG. 7 is a top view of yet another alternative preferred embodiment showing the exercise device in the relaxed position while attached to a seat back and a user. This embodiment uses a single tension cord which is attached to the chest strap at a single centrally located point and attached to the securing strap at a second single centrally located point. This embodiment eliminates the tension strap.

FIG. 7 is another preferred embodiment which uses a minimum number of components. The securing strap 102 is attached to the seat back 112 as was done previously. The tension strap 104 of the previous embodiments is eliminated entirely. The bungee 120 is attached directly to the securing strap 102 by a bungee attachment 702. The bungee attachment 702 can be a sewn on strap, a clip, or any other suitable means to attach the bungee 120 to the securing strap 102. The bungee 120 is also directly attached to the back of the chest strap 502 at a central location via a second bungee attachment 702. The bungee attachment 702 is preferably openable so that the tension can be adjusted by replacing the bungee 120 with another bungee 120 of a different strength. Likewise, the bungee attachment 702 should be openable so that the bungee 120 can be replaced if it is defective. Methods of attaching items such as the bungee 120 to a surface such as the securing strap 102 are well known in the art.

Optionally, the securing strap 102 can have an integral padded section (not shown) with a cutout (not shown) to provide space for the bungee 120 and the bungee attachments 702 when the user 110 is in the relaxed position. When the bungee 120 rests inside the cutout, it would not cause discomfort to the user 110 as might be the case if the user 110 reclined directly against the bungee 120.

This embodiment provides the same function as the previous embodiments with several advantages. First, it has a minimum number of components which reduces cost. Since the chest strap 502 can be implemented without the optional pad 108, the only components required are the securing strap 102, the chest strap 502, the bungee 120 and the cord attachment 702.

Figure 8:
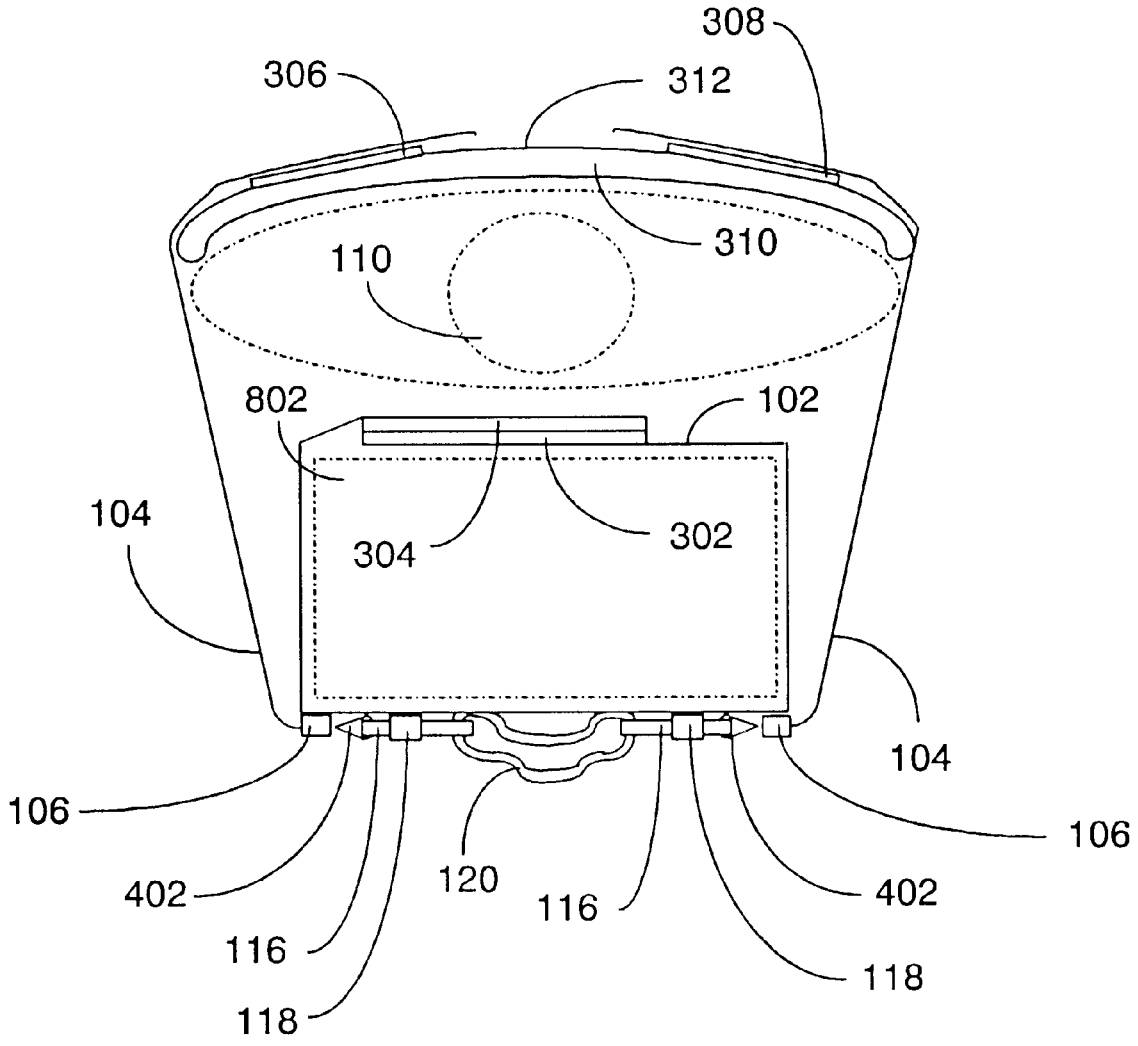
FIG. 8 is a top view of yet another alternative preferred embodiment showing the exercise device in the relaxed position while attached to a fixed object, such as a post.

FIG. 8 is a top view of yet another alternative preferred embodiment showing the exercise device in the relaxed position while attached to a fixed object, such as a post 802, and a user. This embodiment allows the user 110 to exercise while standing up. In addition, the exercise device 100 can be used to exercise the abdomen muscles if the user 110 is facing away from the post 802, or exercise the back, or arms and chest muscles if the user 110 is facing toward the post.

Figure 9:
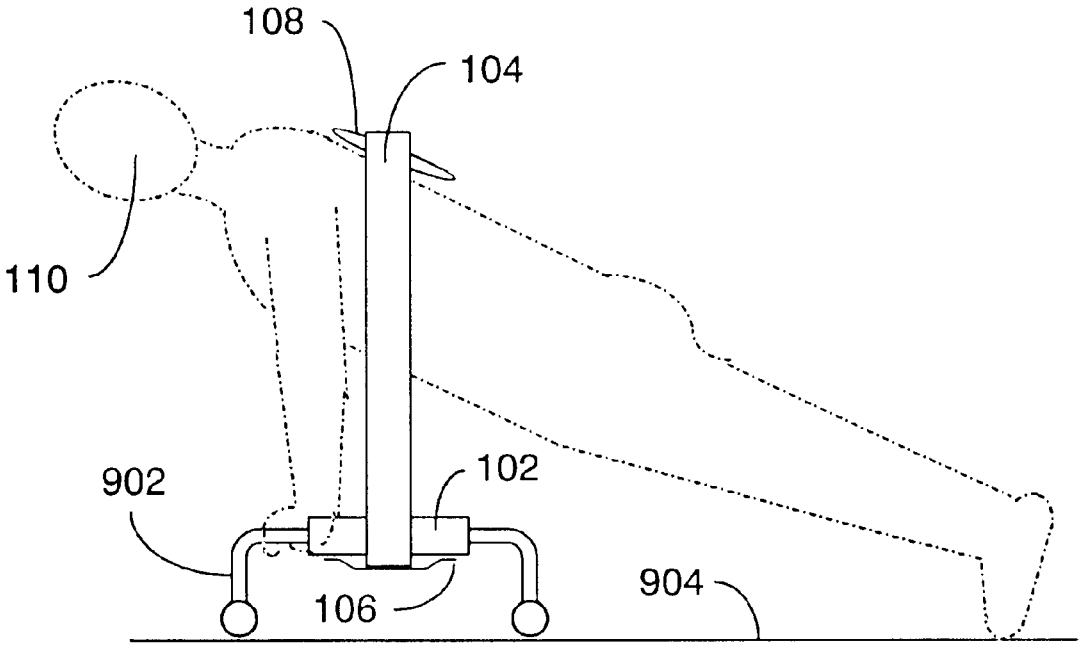
FIG. 9 is a side view showing the exercise device used in conjunction with conventional push-up hand supports.

In FIG. 9, the exercise device 100 is shown being used with a conventional pair of push-up hand supports 902 which rest on a floor 904. For ease of illustration, only one push-up hand support 902 is shown in this view. The user 110, when using exercise device 100 in conjunction with push-up hand supports 902, would secure the securing strap 102 to the push-up hand supports 902. The tension strap 104 would be secured to the user 110 and the securing strap 102 in the same manner as was done for previous embodiments. When a user 110 raises up from the floor 904, the tension exerted by the bungee 120 (shown in FIG. 1B) increases the amount of effort required to do the push up. This allows a user 110 to have a more intense workout when doing conventional exercises such as push ups.

A user 110 can also exercise the arm and leg muscles with the exercise device 100. While laying on the floor, the user 110 can hold the securing strap 102 with the user's feet, and hold the tension strap 104 with the user's 110 arms or shoulders. The user 110 can exercise the calf muscles by extending the toes and exercise the thigh muscles by extending and retracting the legs. Likewise, the user 110 can exercise the biceps by doing arm curls with the tension strap 104 while the securing strap 102 is held by the user's 110 feet. These exercises can also be done from a standing position.

Figure 10:
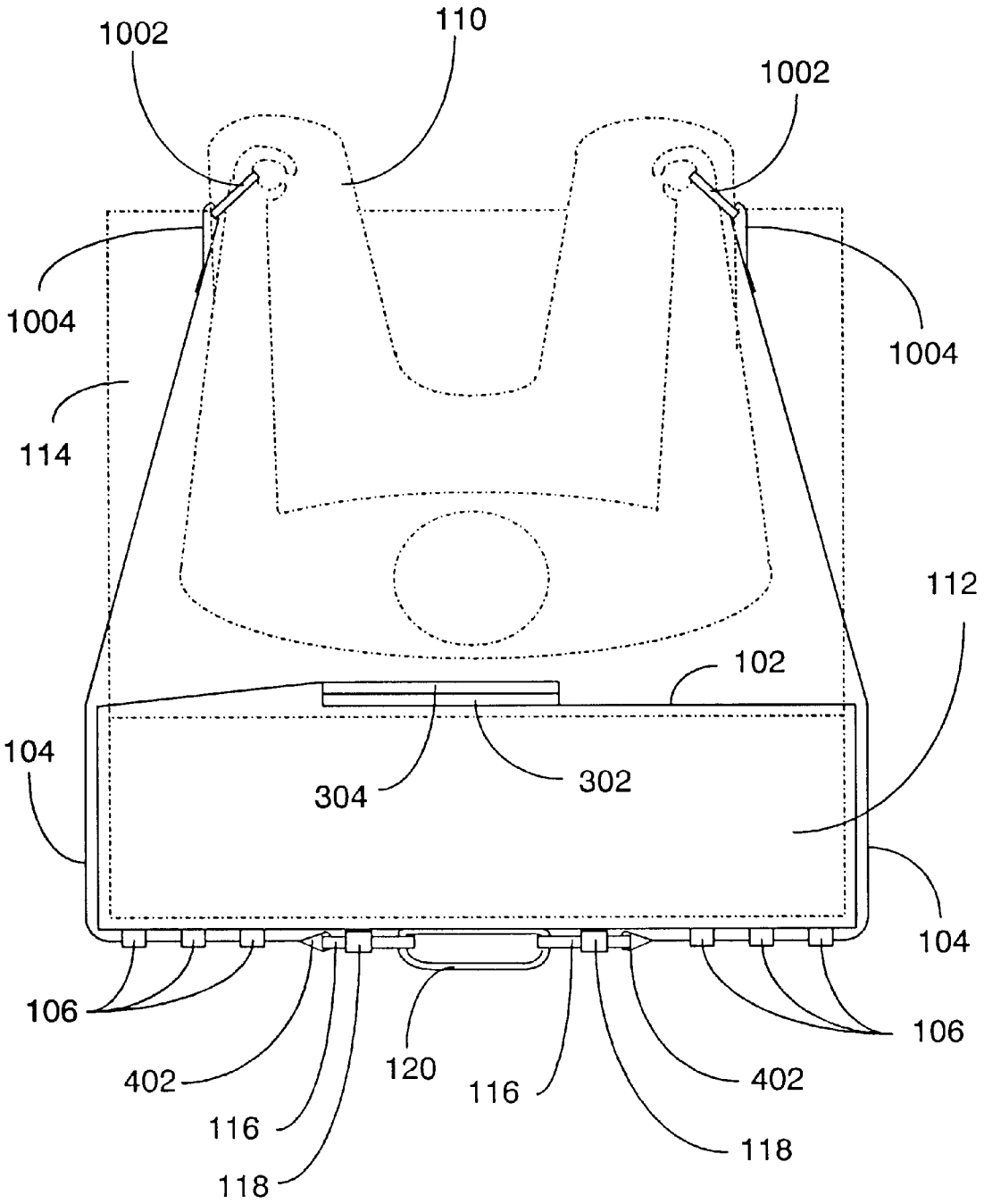
FIG. 10 is an alternative embodiment which use a split tension strap and hand grips to allow the user to do chest and arm exercises from a sitting or standing position.

In FIG. 10, the tension strap 104 is attached via loop 1004 to a hand grip 1002. The hand grips 1002 allow the user 110 to exercise the chest and arm muscles while sitting or standing. Bungee 120 is shown in the tensioned position. The hand grips 1002 can be solid or flexible loops. They can also have openings to allow the tension strap 104 to be installed on the hand grips 1002. Likewise, the tension strap 104 can be inserted through the hand grip 1002 and secured to itself via hook and loop material, etc.

Figure 11:
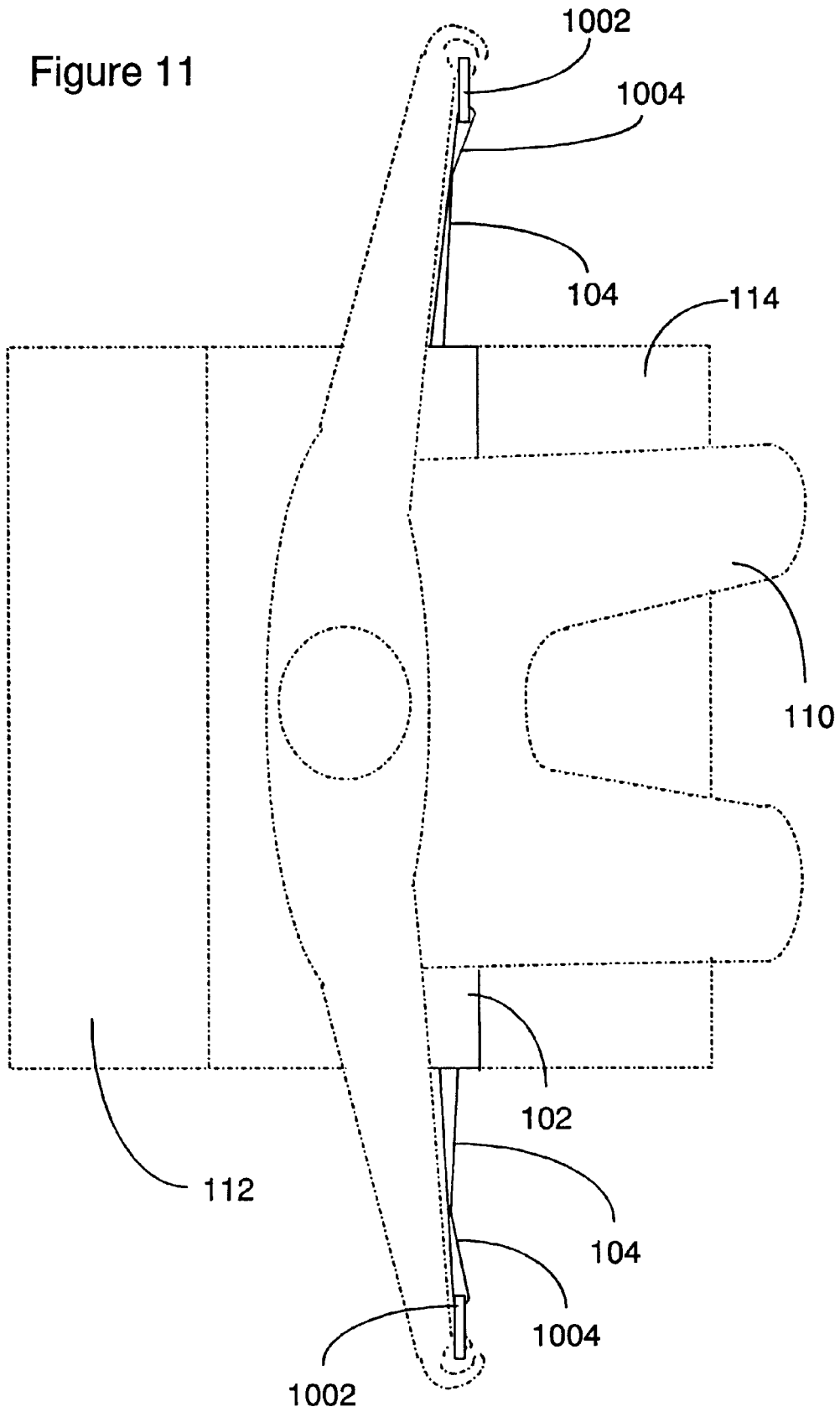
FIG. 11 is an alternative embodiment which use a split tension strap and hand to allow the user to do shoulder and arm exercises from a sitting position.

FIG. 11 illustrates an alternative method of using the embodiment of FIG. 10. In this figure, the securing strap 102 is secured to the seat bottom 114. The tension strap 104 is pulled up via hand grips 1002 to exercise the shoulder and arm muscles.

As can be seen from the foregoing, a significant advantage of the exercise device 100 is that it allows the user 110 to improve posture by exercising both the back and the abdominal muscles. In addition, it can also be used to exercise the abdominal, back, chest, arm, and leg muscles while the user 110 is performing other activities, such as driving, working at a desk, watching television, or even sitting in an airplane seat. By not requiring the user 110 to dedicate time solely to exercise, the user 110 may be more inclined to exercise and have more opportunities to exercise and strengthen the abdominal muscles and back, thereby improving posture and long term health.

While the invention has been described with respect to a preferred embodiment thereof, it will be understood by those skilled in the art that various changes in detail may be made therein without departing from the spirit, scope, and teaching of the invention. For example, the material used to construct the exercise device 100 may be anything suitable for use with a fixed object such as a chair or automobile seat, a wheelchair, a post push-up hand brackets, etc. The size and shape of the exercise device 100 can vary. The type of attachment means, if any, can vary, etc. Accordingly, the invention herein disclosed is to be limited only as specified in the following claims.

We claim:

1. A portable exercise device for use with a fixed support, comprising:

securing means for attachment to a fixed support;

a tension strap having a central portion and two end portions, the tension strap slidably attached to the securing means and extending outward from the securing means with sufficient length to allow the central portion to extend around the chest of an individual when the tension strap is in the relaxed state; and a centrally located tension producing device attached to the ends of the tension strap, the tension producing device providing increasing and equal tension to the ends of the tension strap as the tension strap is moved away from the fixed support such that the tension is evenly distributed to both ends of the tension strap.

2. A device, as in claim 1, further comprising:

releasable attachment means on the securing means for releasable attachment of the securing means to the fixed support the securing means further having a belt structure; and a plurality of retaining straps, the retaining straps attached to the securing means and defining a path through which the tension strap slides.

3. A device, as in claim 2, further comprising:

a pad having means to attach the pad to the tension strap; and the tension strap having means to attach to the pad.

4. A device, as in claim 1, wherein the tension producing device is a bungee cord.

5. A device, as in claim 4, further comprising:

a pad having means to attach the pad to the tension strap; and the tension strap having means to attach to the pad.

6. A portable exercise device for use with a fixed support, comprising:

securing means for attachment to a fixed support;

a tension strap slidably attached to the securing means;

a centrally located bungee cord attached to the ends of the tension strap, the bungee cord providing increasing tension to the tension strap as the tension strap is moved from a relaxed position to a tensioned position;

at least two push-up hand supports, the push-up hand supports resting on a floor, the push-up hand supports held in place during use by the weight of a user; and the securing means secured to the push-up hand supports and the tension strap secured to the user;

whereby the device increases the effort required to do push-up exercises by increasing tension as the user pushes up from the push-up hand supports.

7. A device, as in claim 6, further comprising:

a pad having means to attach the pad to the tension strap; and the tension strap having means to attach to the pad.

8. A portable exercise device for use with a fixed support, comprising:

securing means for attachment to a fixed support;

a tension strap slidably attached to the securing means;

a centrally located tension producing device attached to the ends of the tension strap, the tension producing device providing increasing tension to the tension strap as the tension strap is moved from a relaxed position to a tensioned position;

a chest strap having means to secure to the chest of a user; and the tension strap further having means to attach to the chest strap at a substantially centrally located position;

whereby the tension strap exerts tension in substantially equal proportions to both sides of the user's body.

9. A device, as in claim 8, further comprising an attachment strap, the attachment strap attached at one end to the chest strap and attached at the other end to the tension strap.

10. A device, as in claim 9, further comprising:

a pad having means to attach the pad to the tension strap; and the tension strap having means to attach to the pad.

11. A device, as in claim 8, wherein the tension strap is directly attached to the chest strap at a substantially central location.

12. A device, as in claim 11, further comprising:

a pad having means to attach the pad to the tension strap; and the tension strap having means to attach to the pad.

13. A portable exercise device for use with a fixed support, comprising:

securing means for attachment to a fixed support;

a chest strap for attachment to the chest of an individual; and a centrally located tension producing device attached to the chest strap and to the securing means, the tension producing device attached to the chest strap substantially at the middle of the chest strap and providing increasing tension to the chest strap as the chest strap is moved away from the securing means, and which further distributes tension in substantially equal amounts to each side of the individual as tension is increased.

14. A device, as in claim 13, further comprising:

a pad having means to attach the pad to the chest strap; and the chest strap having means to attach to the pad.

* * * * *